US008869710B2

(12) United States Patent
Sammartino et al.

(10) Patent No.: US 8,869,710 B2
(45) Date of Patent: Oct. 28, 2014

(54) RAILROAD CAR SIDE BEARING

(71) Applicant: Standard Car Truck Company, Park Ridge, IL (US)

(72) Inventors: Giuseppe Sammartino, Mt. Prospect, IL (US); Richard W. Plegge, Palatine, IL (US)

(73) Assignee: Standard Car Truck Company, Park Ridge, IL (US)

( * ) Notice: Subject to any disclaimer, the term of this patent is extended or adjusted under 35 U.S.C. 154(b) by 162 days.

(21) Appl. No.: 13/670,243

(22) Filed: Nov. 6, 2012

(65) Prior Publication Data

US 2013/0145956 A1 Jun. 13, 2013

Related U.S. Application Data

(60) Provisional application No. 61/569,574, filed on Dec. 12, 2011.

(51) Int. Cl.
*B61F 5/14* (2006.01)

(52) U.S. Cl.
CPC ..... *B61F 5/142* (2013.01)
USPC ..... 105/199.3

(58) Field of Classification Search
CPC ..... B61F 5/14; B61F 5/142
USPC ..... 105/199.3
See application file for complete search history.

(56) References Cited

U.S. PATENT DOCUMENTS

| | | | |
|---|---|---|---|
| 3,707,927 | A | 1/1973 | Geyer et al. |
| 3,719,152 | A | 3/1973 | Harter |
| 3,735,711 | A | 5/1973 | Hassenauer |
| 3,888,555 | A | 6/1975 | Van Moss et al. |
| 3,932,005 | A | 1/1976 | Miller |
| 4,103,624 | A | 8/1978 | Hammonds et al. |
| 4,108,080 | A | 8/1978 | Garner et al. |
| 4,567,833 | A | 2/1986 | Hanson |
| 4,712,487 | A | 12/1987 | Carlson |
| 4,793,720 | A | 12/1988 | Merker et al. |
| 4,924,779 | A | 5/1990 | Curtis et al. |
| 5,036,774 | A | 8/1991 | Curtis et al. |
| 5,046,865 | A | 9/1991 | Gatnarek |
| 5,682,822 | A | 11/1997 | Sunderman et al. |
| 6,092,470 | A | 7/2000 | O'Donnell |
| 6,792,871 | B2 | 9/2004 | O'Donnell et al. |

(Continued)

FOREIGN PATENT DOCUMENTS

WO 2008/043026 A2 4/2008

OTHER PUBLICATIONS

International Search Report and Written Opinion from PCT Application No. PCT/US2012/088910, dated Mar. 28, 2013.

*Primary Examiner* — Zachary Kuhfuss
(74) *Attorney, Agent, or Firm* — Neal, Gerber & Eisenberg LLP

(57) ABSTRACT

A railroad car side bearing including a cage, a cap, a lock out insert configured to be removably connected to the cage, and an elastomer element configured to mate with the lock out insert. The lock out insert includes a key that is dimensioned based on a diameter of an interior channel of the elastomer element. Different lock out inserts with different dimensioned keys for different elastomer elements enable a common cage and a common cap to be used with different elastomer elements with different interior channel dimensions, thus reducing the need to have different cages.

24 Claims, 19 Drawing Sheets

(56) References Cited

U.S. PATENT DOCUMENTS

| | | | | |
|---|---|---|---|---|
| 7,527,131 | B1 | 5/2009 | Wike | |
| 7,546,807 | B2 | 6/2009 | Johnstone et al. | |
| 7,549,379 | B2 | 6/2009 | Monaco et al. | |
| 7,802,524 | B1 | 9/2010 | Gregar | |
| 8,136,457 | B2 | 3/2012 | Sammartino | |
| 8,534,202 | B2 * | 9/2013 | McKisic et al. | 105/199.3 |
| 2003/0106456 | A1 | 6/2003 | Faryniak et al. | |
| 2005/0087092 | A1 | 4/2005 | McKisic et al. | |

* cited by examiner

RAILROAD CAR SIDE BEARING

PRIORITY CLAIM

This application is a non-provisional of, claims priority to and the benefit of U.S. Provisional Patent Application Ser. No. 61/569,574, filed Dec. 12, 2011, the entire contents of which are incorporated herein.

BACKGROUND

The railroad industry employs a large variety of different freight railroad cars for transporting various products. Freight railroad cars travel along railroad tracks on front and rear railway car trucks. Each railway car truck typically includes a pair of side frames that extend parallel to each other and that are connected by a bolster. The side frames are supported by front and rear wheel sets. The bolster is typically connected to the side frames via spring assemblies respectively mounted on the side frames. The bolster includes a centrally positioned bolster bowl configured to receive a center plate of a railroad car body.

The typical bolster bowl is circular and includes a depressed middle portion configured to receive a correspondingly shaped circular center plate attached to the bottom of the railroad car body. The circular shape of the bolster bowl and the center plate of the car body enable the railway car truck to pivot laterally (e.g., yaw) while maintaining relative stability of the car body. For example, the bolster bowl enables a railway car truck to pivot based on a curvature of the tracks without substantially affecting the stability of the car body.

Side bearings, and particularly constant contact side bearings, are typically connected to the bolster of each truck of a freight railroad car to provide additional stability for the car body during travel. Two side bearings are typically respectively located on bearing pads on the bolster between the bolster bowl and the side frames (i.e., on opposite sides of the bolster bowl). To provide additional stability for the car body and trucks, the side bearings are configured to continuously maintain contact with the underside of the car body when the freight railroad car is full, and more importantly when the freight railroad car is empty. In this manner, the side bearings provide additional points of contact between the car body and the bolster to provide desired control of the car body and to prevent car body dynamic instances. Each such side bearing typically includes a spring and/or elastomer element configured to apply pressure or forces between the car body and the bolster to prevent or limit such undesired movement of the car body relative to the bolster and side frames. In other words, constant contact side bearings tend to provide a higher level of functionality when a freight railroad car is empty then when it is filled.

FIGS. 1, 2, 3, 4A, 4B, 4C, and 4D generally illustrate sets of commercially available constant contact side bearing assemblies. Each different side bearing assembly shown in FIGS. 4A, 4B, 4C, and 4D is configured to provide a different amount of pre-load. Each different side bearing assembly generally includes a different cage (i.e., one of the cages 116A, 116B, 116C, and 116D respectively shown in FIGS. 4A, 4B, 4C, and 4D), a different elastomer element (i.e., one of the elastomer elements 114A, 114B, 114C, and 114D respectively shown in FIGS. 4A, 4B, 4C, and 4D), and a same cap (i.e., 112 shown in each of FIGS. 4A, 4B, 4C, and 4D).

More specifically, FIG. 1 shows part of a bolster 102 of a rail car truck. The bolster 102 is attached at a first end to a side frame (not shown) that extends transverse to the bolster 102. The opposite or second end (not shown) of the bolster 102 is also attached to a second side frame (not shown). The bolster 102 of FIG. 1 includes a bolster bowl 106 configured to receive a center plate (not shown) of a car body (not shown) as described above.

FIG. 1 also shows an exploded view of one of these known constant contact side bearings 108 attached to a bearing pad 110 on the bolster 102. The bearing pad 110 provides a flat surface for securement of the constant contact side bearing 108.

An enlarged exploded view of this known side bearing 108 is better illustrated in FIG. 2 and an assembled view of this side bearing 108 is better illustrated in FIG. 3. The side bearing 108 includes a cap 112, an elastomer element 114, and a cage 116. This cage 116 (which is one of the four different cages of FIGS. 4A, 4B, 4C, and 4D) is configured to be secured to the bolster 102, and in particular is connected to the bolster 102 and/or the bearing pad 108 via mounting bolts extending through mounting holes 202.

The cage 116 illustrated in FIGS. 1, 2, and 3 includes a base 204 integrally formed with and connected to a side wall 206. The cage 116 also includes an integrally formed and connected key 208 that extends upwardly from the base 204 in the inner compartment defined by the cage 116. The side wall 206 of the cage 116 defines cap receiving channels 212A and 212B. The cap receiving channels 212A and 212B are defined in opposite sides of the side wall 206. These cap receiving channels 212A and 212B are configured to receive corresponding cap side wall extensions 216A and 216B of the cap 112 to facilitate the coupling of the cap 112 to the cage 116. The cap side wall extensions 216A and 216B are respectively received in the cap receiving channels 212A and 212B to enable the cap 112 to move vertically in relation to the cage 116 while at the same time preventing the cap 112 from rotating relative to the cage 116.

The top or top wall 218 of the cap 112 illustrated in FIGS. 1, 2, and 3 is configured to engage the bottom of the car body (or a plate thereon). The cap 112 moves vertically within the cage 116 based on the upward force exerted by the elastomer element and the downward force exerted by the car body. In certain instances, the vertical movement of the cage 116 in relation to the cap 112 is based on forces received via the bolster 102.

The elastomer element 114 shown in FIGS. 1 and 2 is configured to be positioned in the cage 116 between the base 204 of the cage 116 and inside the cap 112 to absorb the vibrations between the car body and the bolster, to counteract downward forces applied by the car body toward the bolster 102, and/or to apply an upward force against the bottom of the car body. The elastomer element 114 includes an interior channel 210 which has a diameter corresponding to a diameter of the key 208 of the cage 116. The key 208 is formed in a cross shape to engage the interior channel 210 of the elastomer element 114 at the four edges of the cross. The connected cage 116 and cap 112 enclose the elastomer element 114 as shown in FIG. 3. The range of vertical of travel of the cap 112 in relation to the cage 116 is based in part on the dimensions of the elastomer element 114 and other elastomer properties of the element 114. The Association of American Railroads (AAR) defines the acceptable or desired amount of travel of the cap in relation to the cage as the travel of the side bearing. The AAR specifies maximum travel distances based on the type of freight railroad cars utilizing the side bearing.

One known significant unsolved problem with these side bearings is that different cages have to be manufactured for use with the different elastomer elements. This problem is generally illustrated by FIGS. 4A, 4B, 4C, and 4D, which show commercially available different cages 116A, 116B, 116C, and 116D and different elastomer elements 114A, 114B, 114C, and 114D. The AAR specifies that different side bearings are to have certain compressive (e.g., preload) properties based on a type of freight railroad car. For instance, the side bearing may have to include an elastomer element with relatively rigid elastomer properties to support freight railroad cars that are heavier when empty. One known way to change properties of the elastomer element is to vary the diameter of the interior channel. Such elastomer elements with interior channels that have relatively larger diameters tend to be more compressible (e.g., support relatively lighter loads) compared to such elastomer elements with interior channels that have relatively smaller diameters. Different cages 116A, 116B, 116C, and 116D with different diameter keys must be employed to accommodate the different interior channels 210A, 210B, 210C, and 210D and diameters of the channels of these different elastomer elements. The exterior dimensions of the different cages (e.g., the cages 116A, 116B, 116C, and 116D) are typically the same to reduce manufacturing variations.

FIGS. 4A, 4B, 4C, and 4D generally show that the same cap 112 may be used with each of the combinations of different cages and different elastomer elements. The cap 112 includes an element cap post 402 that can fit within each of the interior channels 210A, 210B, 210C, and 210D of the elastomer elements. To accommodate all of the diameters of the interior channels, the element cap post 402 may not fully contact some of the interior channels that have relatively large diameters. In these instances, the elastomer element may have a relatively loose connection with the cap.

It should be appreciated from the above that manufacture of these known commercially employed side bearings includes selecting one of the cage and the corresponding elastomer element combinations. Each of the cages 116A, 116B, 116C, and 116D has a different respective key 208A, 208B, 208C, and 208D with a diameter that corresponds to a diameter of the respective interior channels 210A, 210B, 210C, and 210D of the elastomer elements. For example, the cage 116A includes the key 208A that has a relatively large diameter compared to the keys 208B, 208C, and 208D. The diameter of the key 208A is dimensioned to accommodate the interior channel 210A to enable the elastomer element 114A to attach to the cage 116A. In other words, the diameter of the key 208A is sized to have a relatively strong or tight fit or connection with the interior channel 210A when the elastomer element 114A is placed in the cage 116A during manufacture of the side bearing.

Similarly, the cage 116B includes the key 208B that has a diameter that corresponds to the interior channel 210B of the element 114B, the cage 116C includes the key 208C that has a diameter that corresponds to the interior channel 210C of the element 114C, and cage 116D includes the key 208D that has a diameter that corresponds to the interior channel 210D of the element 114D. In each of these different combinations, the same cap 112 can be connected to any of the cages 116A, 116B, 116C, and 116D as mentioned above.

Thus, it should be appreciated that to manufacture each of the different combinations illustrated in FIGS. 4A, 4B, 4C, and 4D, a manufacturer must make each of these different cages and the each of these different elastomer elements. In many instances, the cages are relatively costly and time consuming to manufacture in part because they are cast from steel or iron. Additionally, the manufacturer has to track, inventory, and package each of the different cages. Any mistakes in tracking the different cages can result in a cage being paired with a wrong elastomer element, thereby potentially violating AAR standards. Moreover, if the manufacturer does not properly inventory the cages, the manufacture of the ordered side bearing may be delayed until additional cages are made. It should be appreciated that the need to manufacture four different cages substantially increases manufacturing expenses, and waste time and energy. Accordingly, there is a need to solve these problems.

SUMMARY

The present disclosure solves the above problems by providing a single cage configured to receive multiple different lock out inserts which have different keys which are configured to be connected to different elastomer elements. Each of the different lock out inserts includes a different key that is dimensioned to specifically fit an interior channel of a different one of the elastomer elements. When a lock out insert is connected to a cage, the key assists in ensuring that the appropriate elastomer element is attached to the cage and that the desired side bearing is formed.

In the present disclosure, the different lock out inserts are much easier and much less expensive to manufacture compared to manufacturing and maintaining different cages as described above because the lock out inserts are much easier, less expensive, less time consuming, and less energy demanding to manufacture. The present disclosure enables manufacturers to produce common caps and common cages for differently rated side bearings while only having to produce different lock out inserts with differently sized keys for different elastomer elements to make the required different side bearings. In other words, instead of having to manufacture, inventory, and track different cages as described above, manufacturers only have to manufacture, inventory, and track different lock out inserts and elastomer elements which are each usable with a single cage and a single cap.

Each side bearing of various embodiments of the present disclosure thus includes a cage, a cap, one of a plurality of different lock out inserts, and one of a plurality of different elastomer elements. More specifically, in one example embodiment, the cage has a base and a side wall integrally formed with the base. The base and the side wall define locking tab receiving slots. The base also defines a key opening. Each lock out insert in this example embodiment includes a body, a key attached to the body, and two arms which each include a locking tab. The locking tabs are configured to be inserted into the locking tab receiving slots, and in certain embodiments to attach the lock out insert to the cage by snap fitting into the respective locking tab receiving slots. The key which extends tangentially from the body has a diameter smaller than a diameter of the key opening of the base of the cage, thereby enabling the key to fit through the key opening when the lock out insert is mated with or attached to the cage. The railroad car side bearing additionally includes a cylindrical spring element (such as an elastomer element) with an interior channel. The diameter of the interior channel corresponds to the diameter of the key so that the cylindrical spring element can be attached to the key and secured within the cage. The side bearing further includes a cap connected to the cage to enclose the cylindrical spring element.

Other objects, features and advantages of the present invention will be apparent from the following detailed disclosure, taken in conjunction with the accompanying sheets of drawings, wherein like reference numerals refer to like parts.

DETAILED DESCRIPTION

The present disclosure provides a set of different side bearings, each of which can be assembled using a common cage, a common cap, one of a plurality of different lock out inserts, and one of a plurality of different elastomer elements. Each different lock out insert includes a key that is differently dimensioned to correspond to an interior channel of a different elastomer element. While the present application describes various examples of side bearing components including different lock out inserts, different elastomer elements, a same cage, and a same cap, it should be appreciated that the present disclosure is not limited to these example side bearing components.

Figure 1:
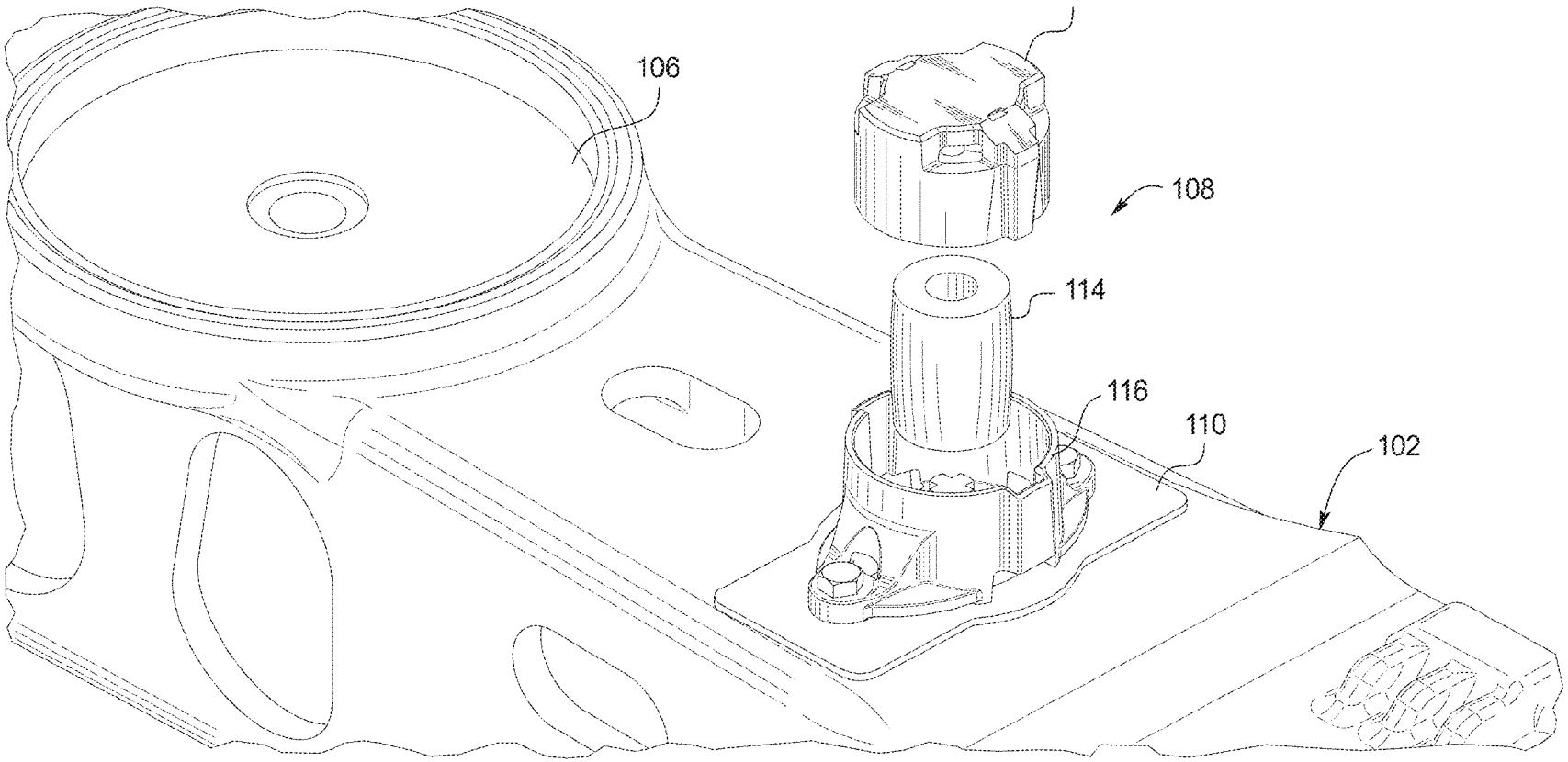
FIG. 1 (PRIOR ART)
FIG. 1 is an exploded perspective view of a known commercially available railroad car truck side bearing including a cage, an elastomer element, and a cap, and which shows the cage mounted on a portion of a bolster (shown in fragmentary).
Figure 2:
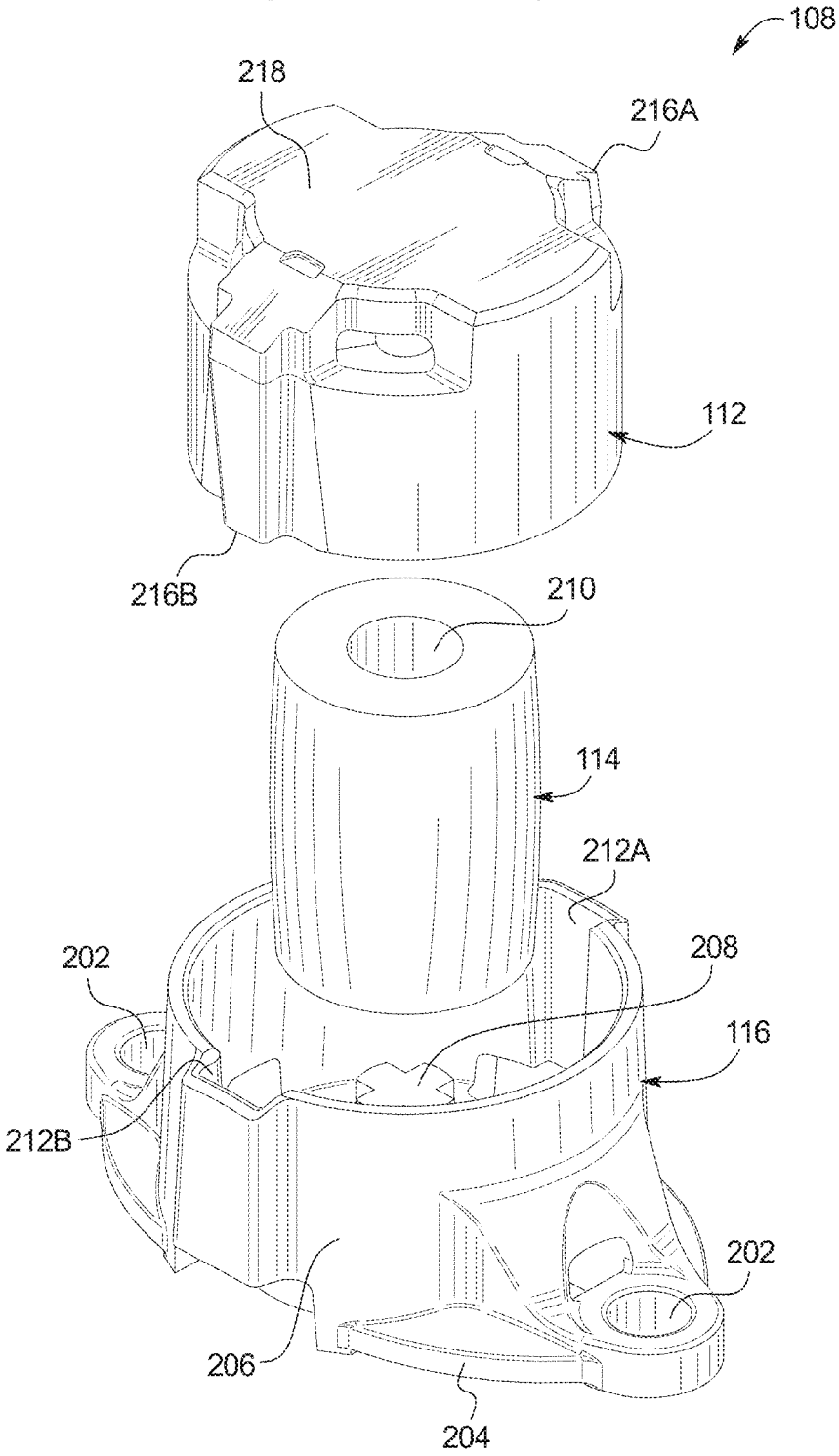
FIG. 2 (PRIOR ART)
FIG. 2 is an exploded side perspective view of the known side bearing of FIG. 1.
Figure 3:
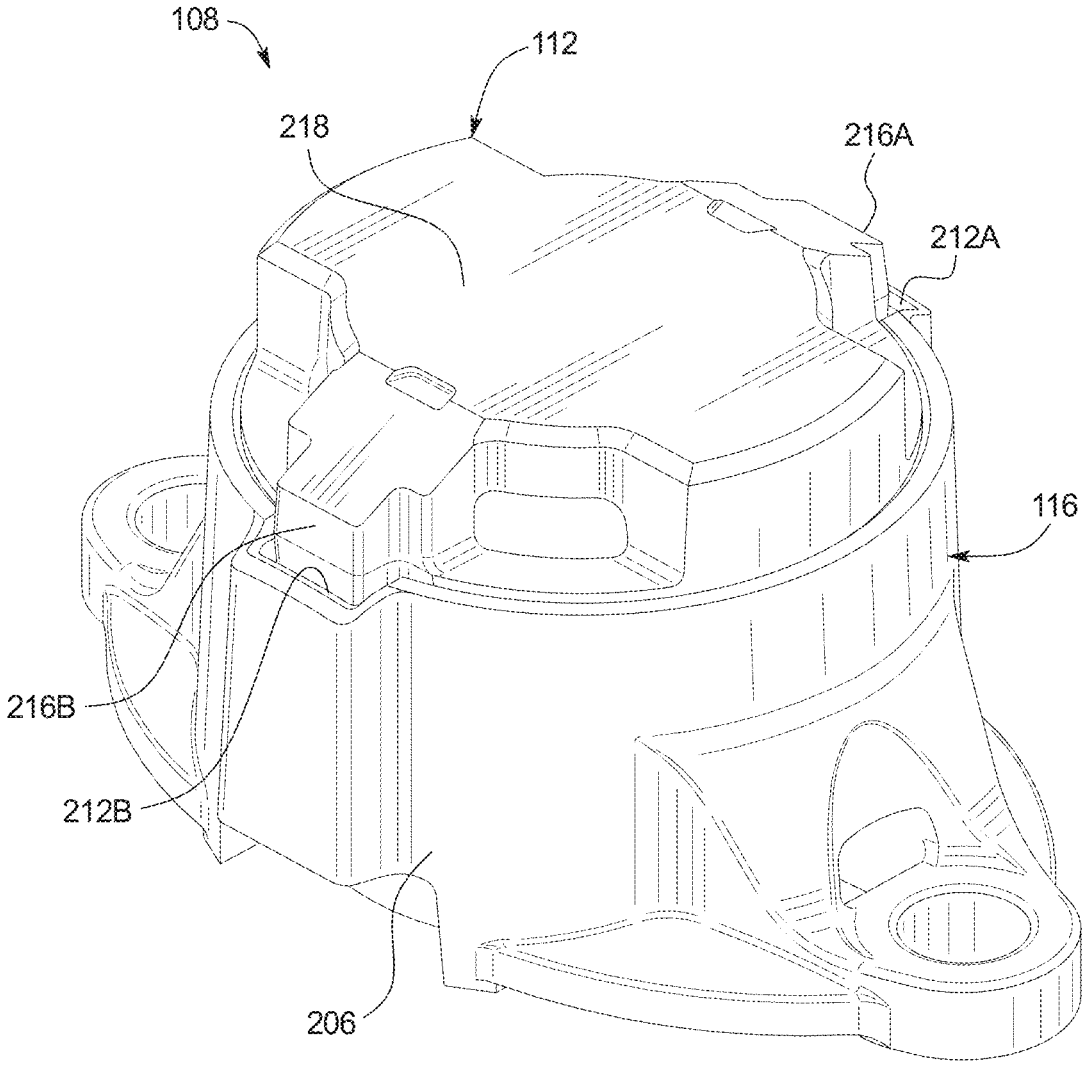
FIG. 3 (PRIOR ART)
FIG. 3 is an assembled side perspective view of the known side bearing of FIG. 1.
Figure 4A:
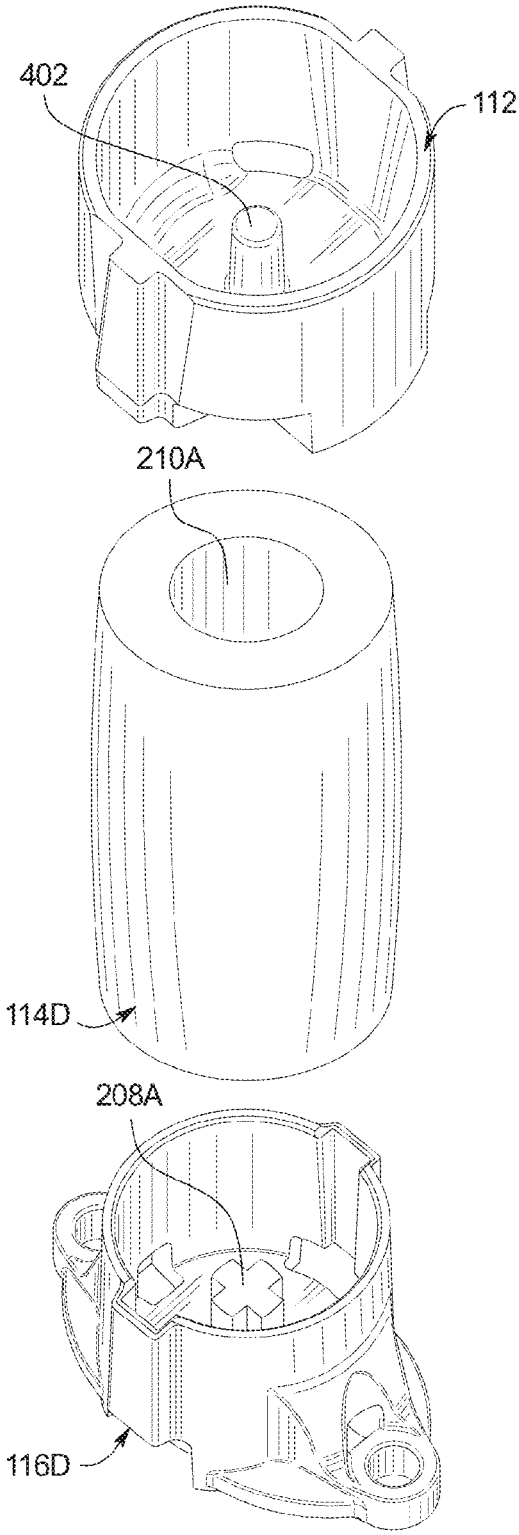
FIG. 4A (PRIOR ART)
FIGS. 4A, 4B, 4C, and 4D are perspective views of caps, cages, and elastomer elements used to create different sets of the known side bearings.
Figure 4B:
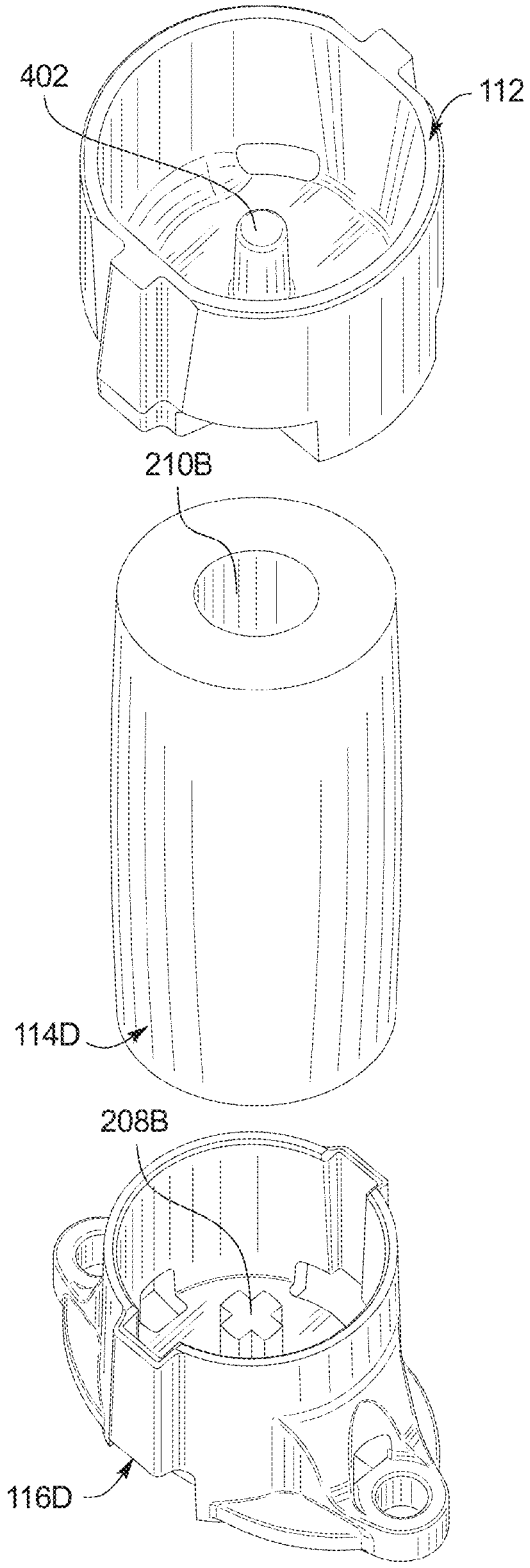
FIG. 4B (PRIOR ART)
Figure 4C:
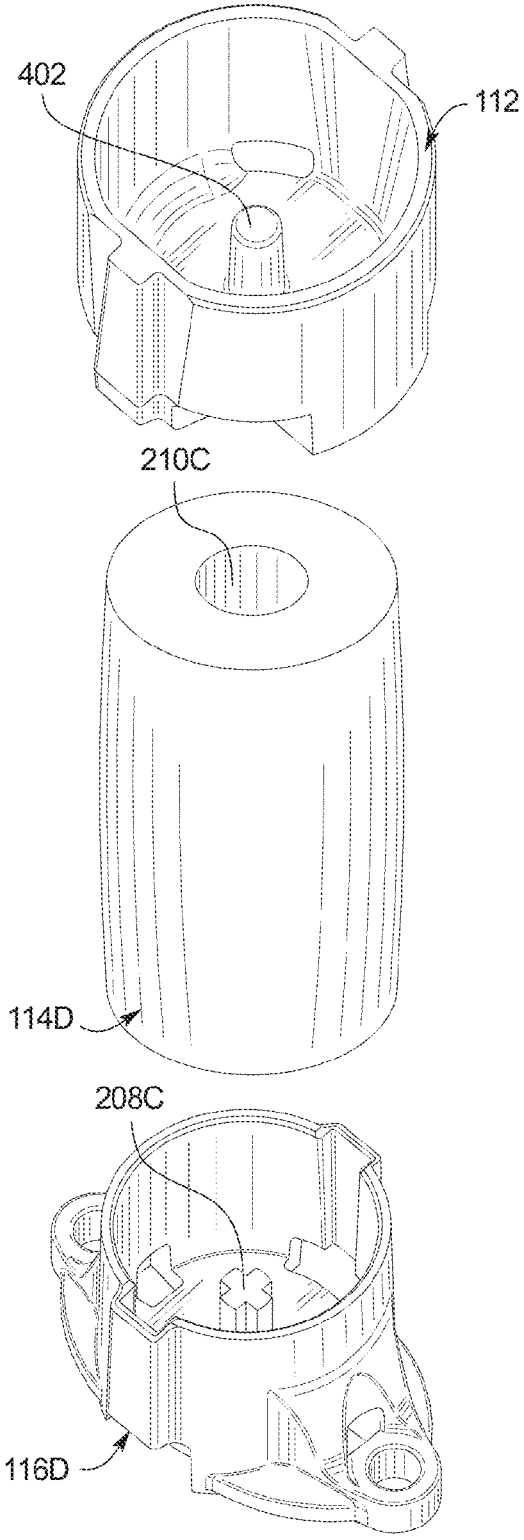
FIG. 4C (PRIOR ART)
Figure 4D:
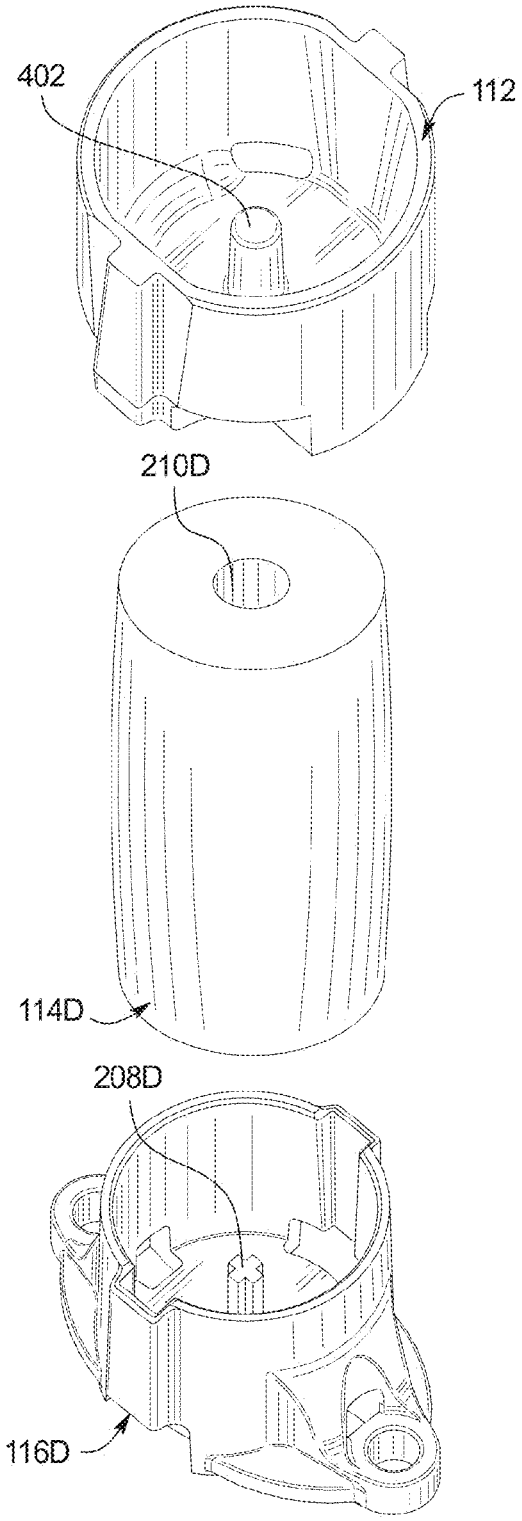
FIG. 4D (PRIOR ART)

FIGS. 5, 6, 7A, 7B, and 8 illustrate an example cage 500 and an example lock out insert 600 of one embodiment of the present disclosure. More specifically, cage 500 is configured to receive any one of a plurality of different lock out inserts. The cage 500 includes a base or base wall 506 having a bottom or first side 508 and a top or second side 510. The cage 500 includes a side wall 512 integrally formed with the base 506. The side wall 512 extends upwardly from the base 506 to form an element receiving area 704 (shown in FIG. 5). The based 506 defines a key opening 502 (shown in FIGS. 5 and 7B). The base 506 and the side wall 512 define locking the tab receiving slots 504A and 504B (shown in FIGS. 5 and 7B) configured to respectively receive locking tabs 612 and 618 of the lock out insert 600 as further described below. The cage 500 includes attachment feet 511A and 511B that respectively define mounting holes 505A and 505B used to connect the cage 500 directly to a bolster or to a bearing pad (such as the bearing pad 110 of FIG. 1) on a bolster. The side wall 512 of the cage 500 also defines cap receiving channels 507A and 507B configured to receive the cap side wall extensions of a cap 112 as discussed above and below.

Figure 7A:
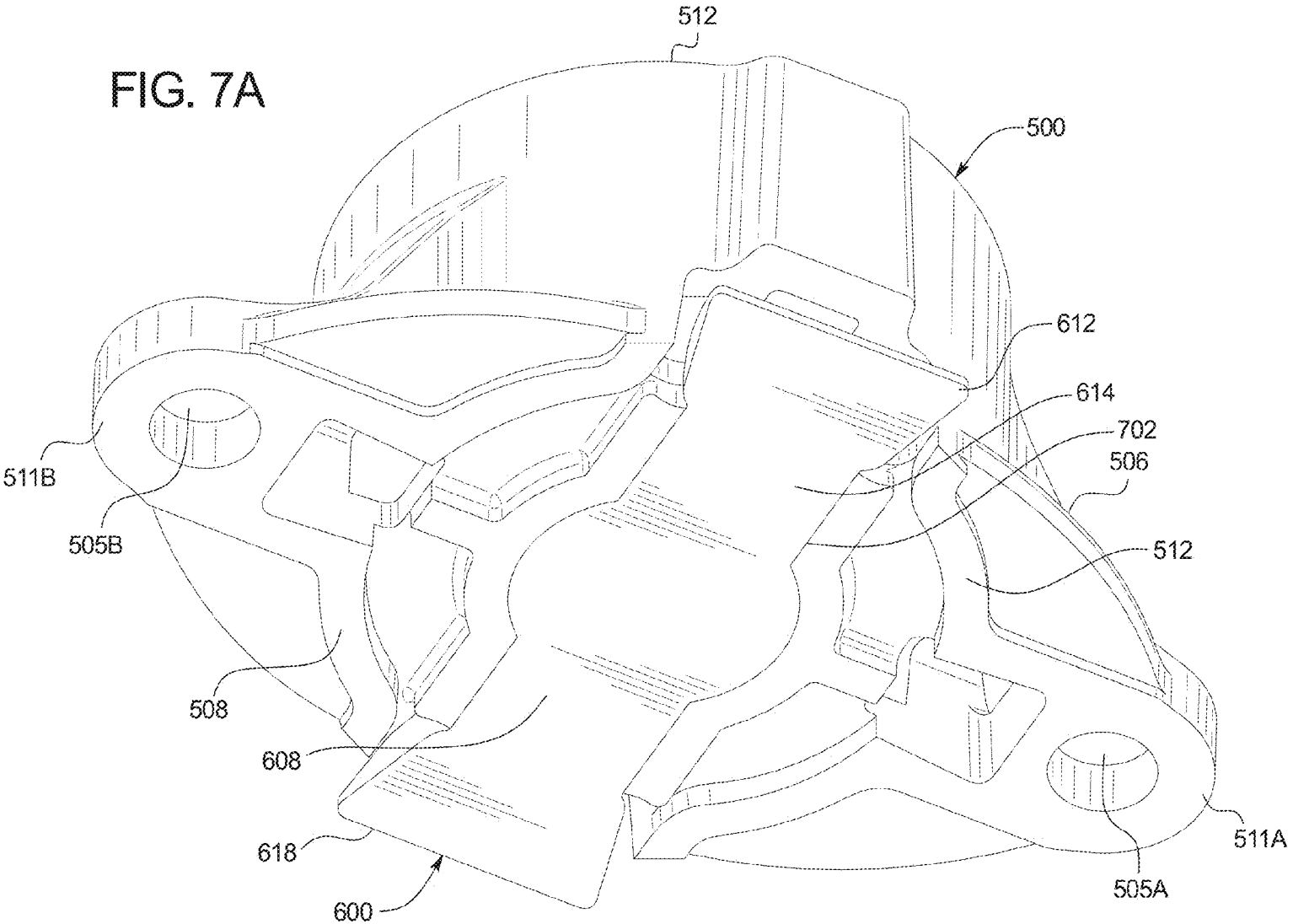
FIG. 7A is a bottom perspective view of the lock out insert of FIG. 6 attached to the bottom of the cage of FIG. 5.
Figure 7B:
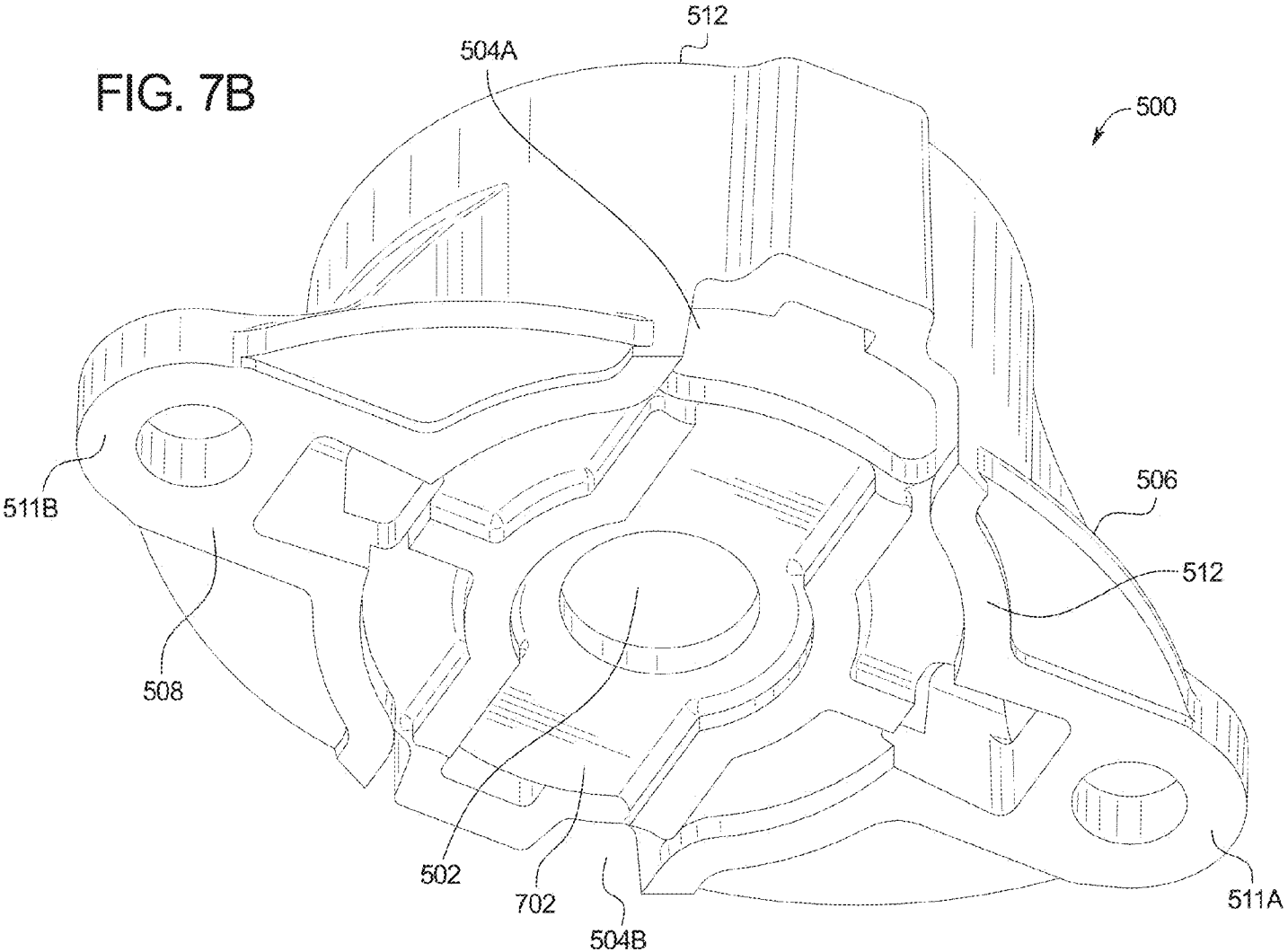
FIG. 7B is a bottom perspective view of the bottom of the cage of FIG. 5 shown without any lock out insert attached to the bottom of the cage.

The bottom or first side 508 of the base 506 includes or defines a lock out insert receiving channel 702 as best illustrated in FIG. 7B. The channel 702 is recessed into the bottom or first side 508 of the base 506 to accommodate the lock out insert 600 (as best shown in FIG. 7A). In this illustrated embodiment, the lock out insert 600 is configured to be attached to the cage 500 such that a bottom side of the lock out insert 600 extends flush with the bottom side 508 of the base 506 (as best shown in FIG. 7A), thereby causing the cage 500 to be level when attached to a bolster or bearing pad on a bolster. The lock out insert receiving channel 702 is configured based on the configuration of the body 602 and the arms 608 and 614 of the lock out insert 600 (which are further described below). However, it should be appreciated that the bottom of the lock out insert does not need to be flush with the bottom of the base of the cage in all embodiments of the present disclosure.

The base 506 and the side wall 512 define the locking tab receiving slots 504A and 504B which each have a curvature partially defined by the side wall 512. The locking tab receiving slots 504A and 504B are respectively configured to receive the locking tabs 612 and 618 of the lock out insert 600 as further discussed below. It should be appreciated that the base and the side wall can alternatively define additional or fewer locking tab receiving slots. It should also be appreciated that the locking tab receiving slots may alternatively be defined only by the base or further alternatively only by the side wall. For example, the locking tab receiving slots may be located in portions of the base which are interior from the side wall.

The key opening 502 enables a key 620 of the lock out insert 600 to extend through the base 506 into the element receiving area 704. The key opening 502 is dimensioned to enable keys of varying diameters on different lock out inserts to extend through the opening 502. In this manner, the key opening 502 enables the same cage 500 to be used with different lock out inserts with different diameter keys.

The dimensions of the example illustrated cage 500 are shown by the relation of dimensions and/or features of the side wall 512 and the base 506. It should be appreciated that the dimensions and/or features of the side wall and/or the base may vary based on side bearing specifications. For example, the dimensions of the locking tab receiving slots may vary to accommodate different locking tab sizes and/or shapes. It should also be appreciated that the dimensions and/or shape of the key opening can vary to accommodate different key sizes and/or shapes. It should also be appreciated that in alternative embodiments, multiple key openings are formed in the base of the cage to accommodate lock out inserts with multiple keys.

Figure 6:
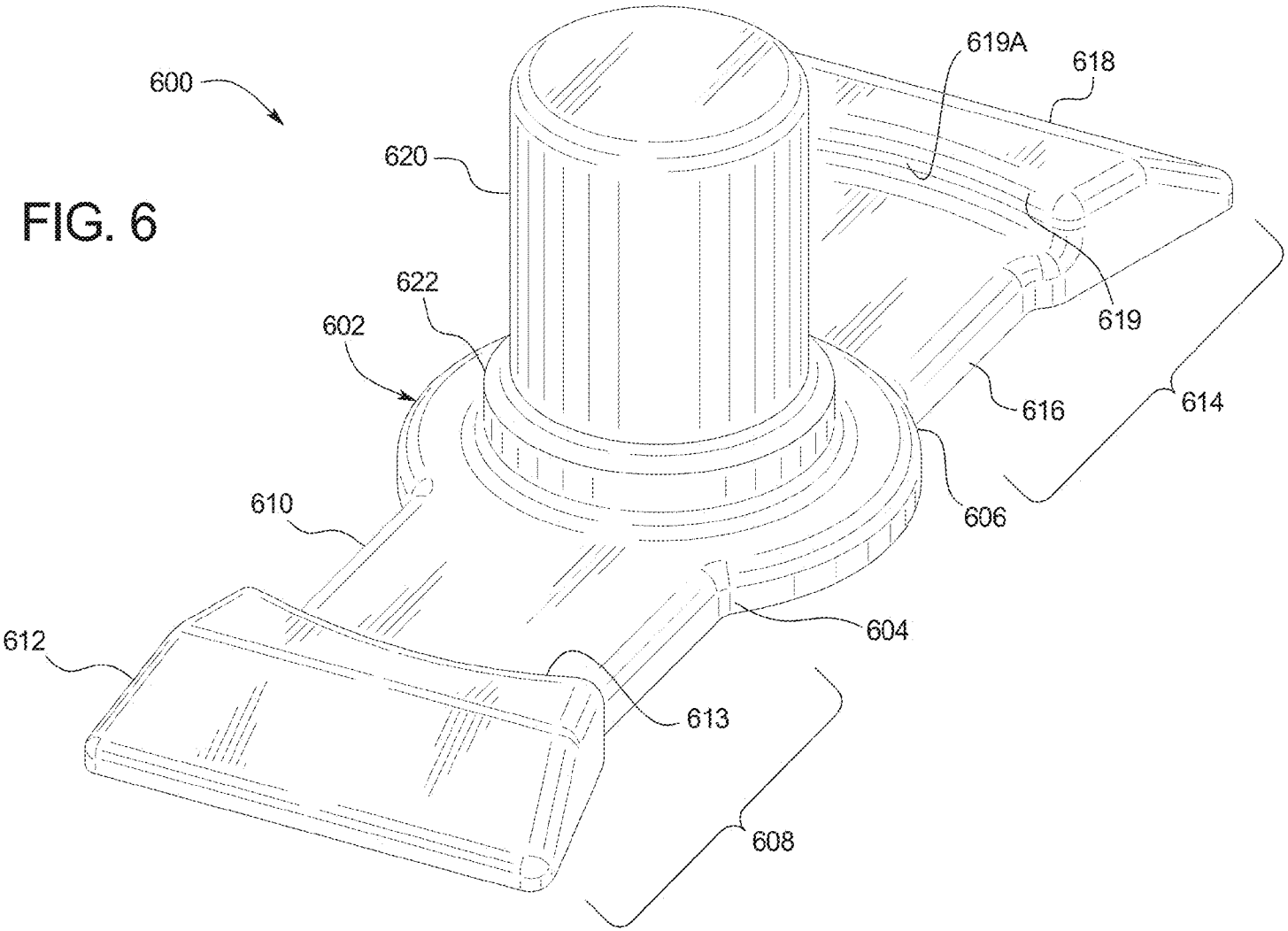
FIG. 6 is top side perspective view of one of the different lock out inserts of one example embodiment of the present disclosure.

FIG. 6 shows a top perspective view of an example lock out insert 600 that is connectable to the cage 500. The lock out insert 600 includes a body 602 having a first end 604 and a second end 606. A first arm 608 is attached to the first end 604. The first arm 608 includes an extension section 610 and a locking tab 612. A second arm 614 is attached to the second end 606 of the body 602. The second arm 614 includes an extension section 616 and a locking tab 618. Extension section 610 is located between the first end 604 and the locking tab 612. Extension section 616 is located between the second end 606 and the locking tab 614. In this illustrated embodiment, the extension sections 610 and 616 fit within the lock out insert receiving channel 702 of or defined by the base 506 of the cage 500. The extension sections 610 and 616 provide structural support for the body 602 when the respective locking tabs 612 and 618 are positioned in and engaged with the base 506 and/or the side wall 512 of the cage 500. It should be appreciated that in alternative embodiments, the lock out insert includes only one arm or more than two arms.

In this illustrated embodiment, the locking tabs 612 and 618 securely attach the lock out insert 600 to the cage 500 by snapping into the respective locking tab receiving slots and contacting the base 506 and the side wall 512. More specifically, in this illustrated embodiment, each of the locking tabs 612 and 618 respectively include curved walls 613 and 619 that respectively defined grooves 613A (not shown) and 619A configured to receive opposite edges of the base 506. More specifically, in this illustrated embodiment, the locking tabs 612 and 618 are connected to the base 506 by causing the respective walls of the locking tabs that define the grooves to securely engage the edges and/or lips of the base 506 that define part of the locking tab receiving slots. It should be appreciated that the locking tabs may be alternatively shaped to engage and/or connect to other portions of the base 506 and/or the side wall 512. It should also be appreciated that in other embodiments, the lock out insert does not snap fit or otherwise securely connect with the base, but rather is just positioned with the base of the cage when installed on the bolster.

The illustrated configuration enables the locking tabs 612 and 618 to be respectively removed from the locking tab receiving slots 504A and 504B and disengaged from the base 506. In this illustrated example embodiment, surfaces of the locking tabs 612 and 618 also engage the side wall 512 which defines the top of the respective slots 504A and 504B. It should be appreciated that the locking tabs 612 and 618 may alternatively be connected to the base 506 and/or the side wall 512 in other suitable manners such as by adhesive(s), mechanical fasteners, weld(s), and/or heat staking in accordance with the present disclosure.

This illustrated embodiment of the lock out insert 600 also includes a key lip 622 and a cylindrical key 620 that tangentially extends from the key lip 622 and the body 602 of the lock out insert 600. The key lip 622 has a diameter that corresponds to a diameter of the key opening 502 defined by the base 506. The key 620 has a diameter that is smaller than the key opening 502. In this illustrated embodiment, when the lock out insert 600 is connected to the cage 500, the key lip 622 securely engages with the circular edge of the base 506 that defines the key opening 502 to provide support, alignment, and positioning for the key 620, and to further provide the snap fit of the lock out insert to the base 506. It should be appreciated that the present disclosure contemplates different diameter keys 620 with a common diameter key lip 622 so that different lock out inserts can be attached to the same cage 500. It should also be appreciated that in other embodiments, the key lip 622 does not snap fit or otherwise securely connect with the base, but rather is just positioned with the base of the cage when installed on the bolster. It should also be appreciated that in other embodiments, the lock out insert does not include a key lip.

FIGS. 7A and 7B show that in this illustrated embodiment, the lock out insert 600 is attached to the cage 500 by aligning the key 620 with the key opening 502 and pressing the insert 600 into the cage 500 so that the body 602 and arms 608 and 614 fit within the lock out insert receiving channel 702. By pressing the insert 600 into the cage 500 in this illustrated embodiment, the locking tabs 612 and 618 engage the edge of base 602 and the side wall 512 that defines the corresponding locking tab receiving slots 504A and 504B. When the lock out insert 600 is connected to the cage 500, the body 602 and/or the arms 608 and 614 provide support for the key 620 by contacting the bottom or first side 508 of the base 506 in this illustrated embodiment. After connecting the lock out insert 600 to the cage 500, an elastomer element can be attached to the key 620 of that lock out insert. In this illustrated embodiment, the diameter of the key 620 corresponds to a diameter of an interior channel of one of the elastomer elements (such as one of elements 114A, 114B, 114C, and 114D) that is to be engaged with the key 620. In this illustrated embodiment, the key 620 diameter is dimensioned so that the interior channel 210 of a corresponding element can accommodate and/or fit over the key 620 while having enough contact force on the inner cylindrical wall of the key 620 to attach and/or engage with the key 620. In other words, in this embodiment, the cylindrical outer side wall of the key 620 contacts the inner wall which defines the interior channel 210 to connect the key 620 to the element. Thus, in this embodiment, the key 620 functions as a lock out that ensures only the element 114 with a correspondingly dimensioned interior channel 210 is paired with the appropriate lock out insert 600 during production of the side bearing. It should be appreciated that in other embodiments, the key may be configured to not cause a direct contact with the inner wall(s) of the element, and that in further embodiments, the key may be configured to cause limited direct contact with the inner wall(s) of the element. The present disclosure further contemplates that in certain embodiments, one or more fastening mechanisms such as but not limited to one or more pins may be employed to maintain the element on the key of the lock out insert.

In the illustrated embodiment, the key 620 has a height that corresponds to a height of the interior channel 210 of the respective or matching elastomer element. Further, the shape of the key 620 corresponds to a shape of the interior channel 210 of the elastomer element in the illustrated embodiment. In these example embodiments, both the interior channel and the key are cylindrically shaped. In other embodiments, if the interior channel has a rectangular shape, the key has a corresponding rectangular shape. In certain embodiments, differently rated elastomer elements may have differently shaped interior channels to provide additional lock out protection to ensure the appropriate key elastomer element combination is used.

It should be appreciated that the lock out insert 600 including, for example, the body 602, the arms 608 and 614, the key 620, and/or the key lip 622 can be made of various different suitable materials. In one example embodiment, the lock out insert is made from a high-density polyethylene. In another example embodiment, the lock out insert is made from a high-density polypropylene. In another example embodiment, the lock out insert is made from a cast or forged metal such as a cast aluminum. It should also be appreciated that the example lock out insert can be made from certain combinations of materials, composite materials, or can be an impregnated material. It should also be appreciated that different lock-out inserts may be made from different materials. It should also be appreciated that making different lock out inserts of such materials is substantially cheaper than making different cages as described above.

It should also be appreciated that each lock out insert can be made in any suitable manner. In one example embodiment, the lock out insert is manufactured using a conventional molding process. It should be appreciated that the lock out insert can be formed from alternative methods and that the employed manufacturing process may in part depend on the shape, size, and material of the lock out insert. Additionally, it should be appreciated that: (a) the material of the lock out insert; (b) the shape and configuration of the lock out insert including its height, width, and depth; and (c) the dimensions of the key can each be specifically selected based on the interior channel of a corresponding elastomer element.

Figure 5:
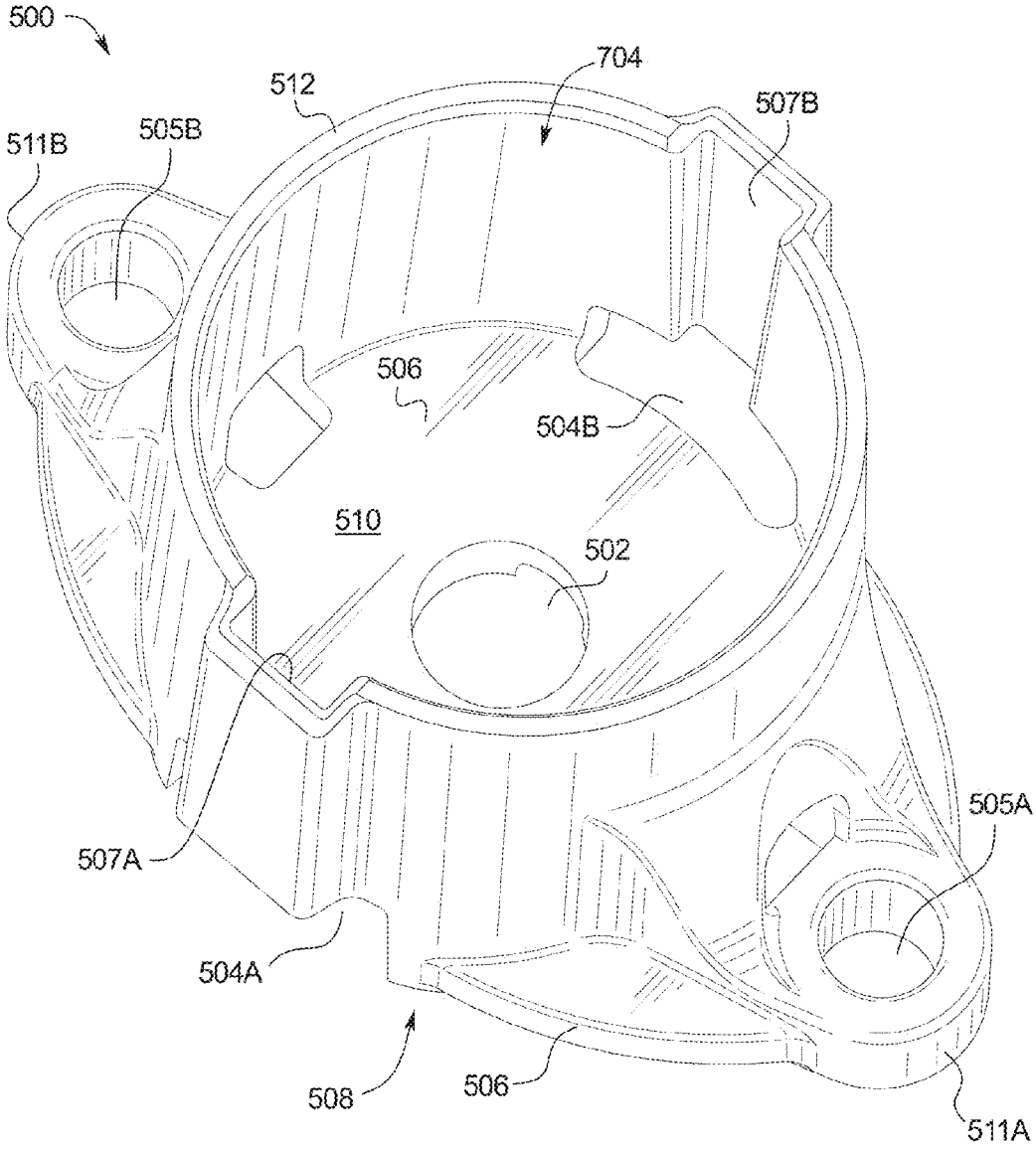
FIG. 5 is a top perspective view of a cage of one example embodiment of the present disclosure.
Figure 8:
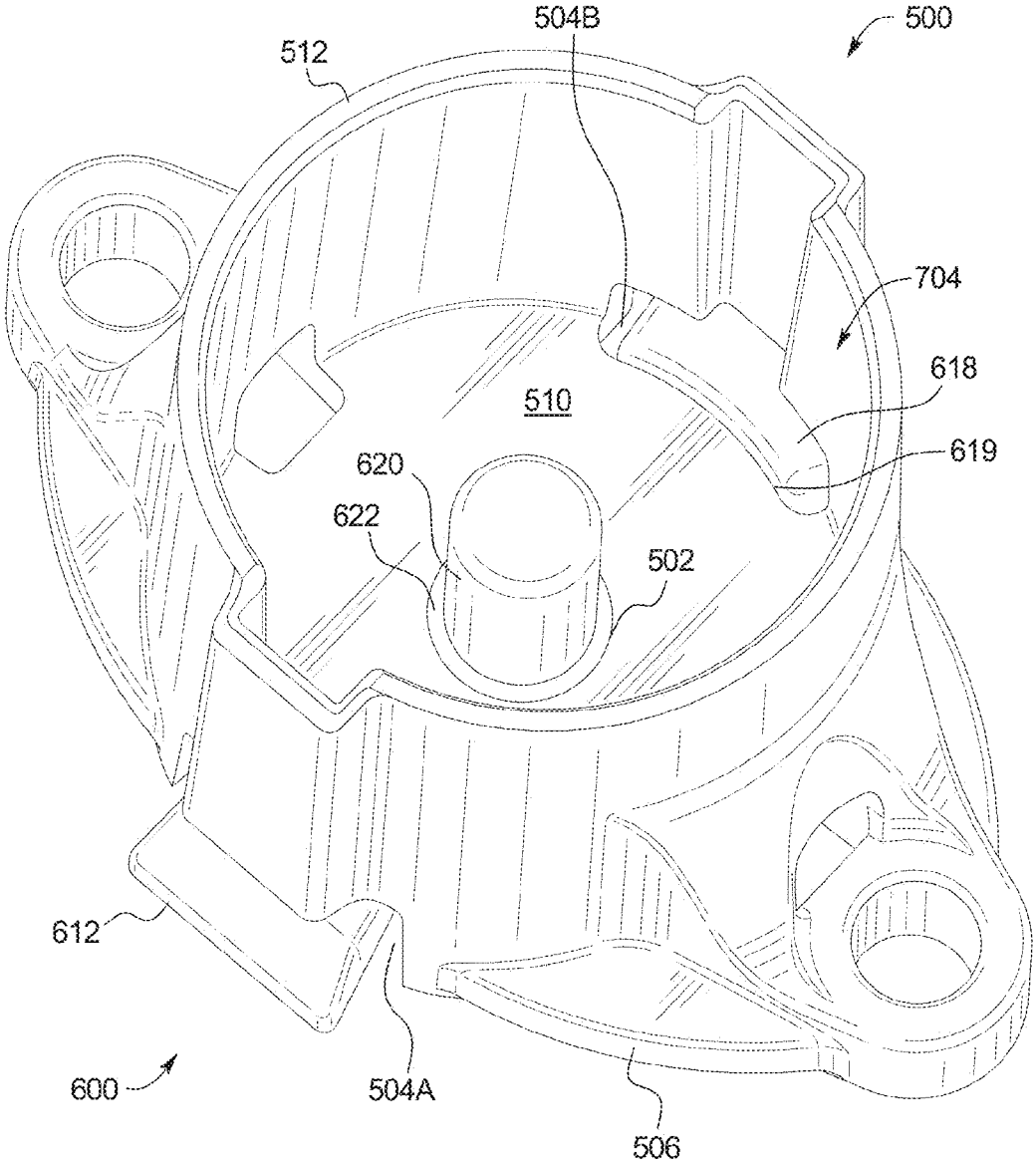
FIG. 8 is a top side perspective view of the lock out insert of FIG. 6 attached to the cage of FIG. 5.
Figure 9A:
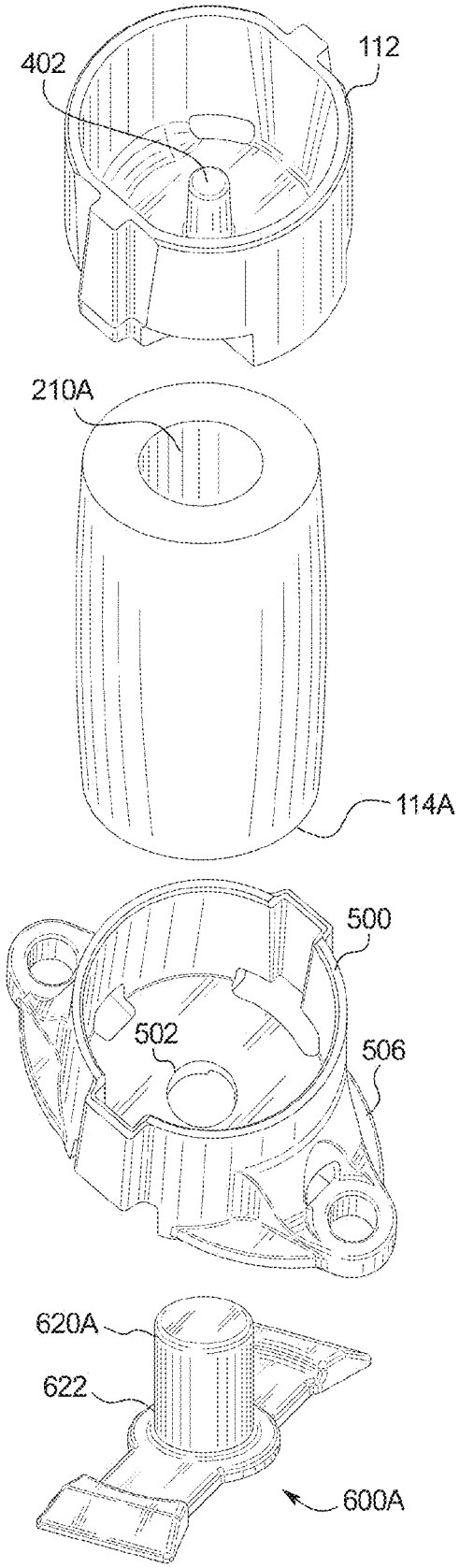
FIGS. 9A, 9B, 9C, and 9D are perspective views of example different lock out inserts and corresponding example different elastomer elements that can be used with the cage of FIG. 5 and the cap to create different sets of side bearings of the present disclosure.
Figure 9B:
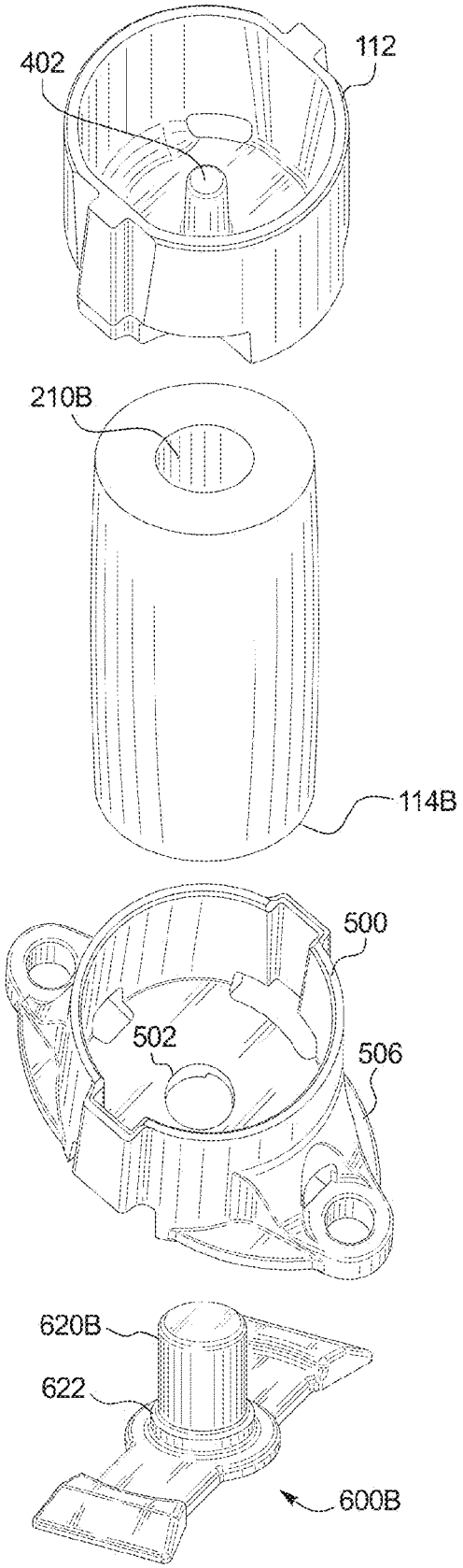
Figure 9C:
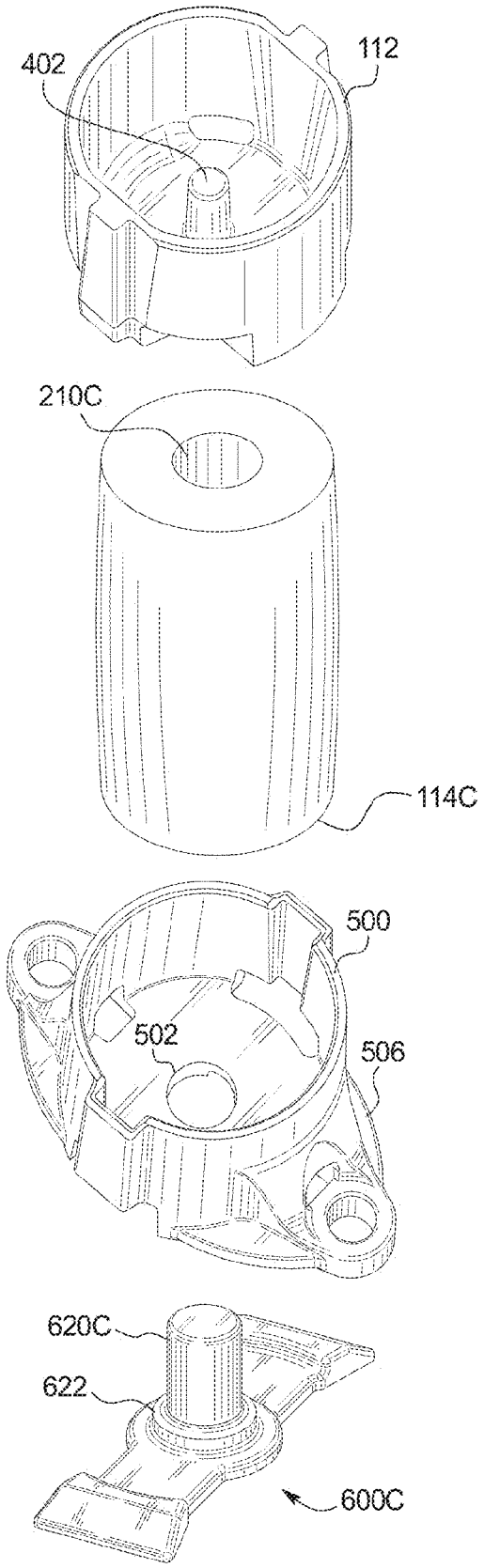
Figure 9D:
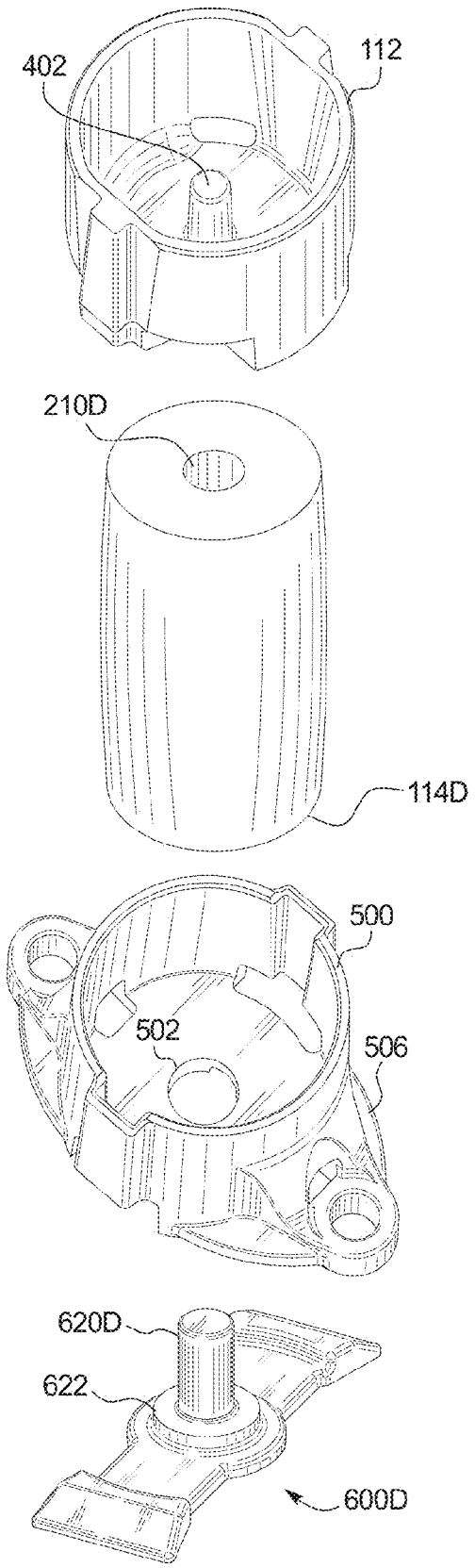

FIGS. 9A, 9B, 9C, and 9D shows a set of example lock out inserts 600A, 600B, 600C, and 600D and corresponding example elastomer elements 114A, 114B, 114C, and 114D that can be used with the example cage 500 of FIGS. 5, 7, and 8 and the example cap 112 of FIGS. 1, 2, 3, 4A, 4B, 4C, and 4D, 9A, 9B, 9C, and 9D to create different side bearings depending on the desired specifications of those side bearings. The lock out inserts 600A, 600B, 600C, and 600D each have the same configuration of the lock out insert 600 illustrated in FIGS. 6, 7, and 8. In this example, the same cap 112 and the same cage 500 can be used with any of the different insert-elastomer element combinations as shown in FIGS. 9A, 9B, 9C, and 9D, which significantly reduces the number of different cages that have to be manufactured and inventoried. Further, while the example different combinations shown in FIGS. 9A, 9B, 9C, and 9D, each include the lock out inserts 600A, 600B, 600C, and 600D with cylindrical keys 620A, 620B, 620C, and 620D, it should be appreciated that each of the keys 620A, 620B, 620C, and 620D could have different shapes based on the shapes of the corresponding interior channels 210A, 210B, 210C, and 210D.

In this illustrated example set of side bearings: (a) the lock out insert 600A includes the key 620A with a diameter that corresponds to the diameter of the interior channel 210A; (b) the lock out insert 600B includes the key 620B with a diameter that corresponds to the diameter of the interior channel 210B; (c) the lock out insert 600C includes the key 620C with a diameter that corresponds to the diameter of the interior channel 210C; and (d) the lock out insert 600D includes the key 620D with a diameter that corresponds to the diameter of the interior channel 210D. Thus, the diameter of the key 620A prevents the elements 114B, 114C, and 114D from being attached to the lock out insert 620A because the interior channels 210B, 210C, and 210D are too narrow to accommodate (e.g., fit around) the key 620A.

The examples embodiments of FIGS. 9A, 9B, 9C, and 9D show that each of the lock out inserts 600A, 600B, 600C, and 600D include the same size key lip 622 so that the inserts 600A, 600B, 600C, and 600D can each be attached to the base 506 of the cage 500. Additionally, the example lock out inserts 600A, 600B, 600C, and 600D include suitable different identifiers used to determine which respective insert should be used with which of the elastomer elements to form the differently rated side bearings. For example, the identifier (e.g., SBXII-30) indicates that the insert 600A is to be installed within a SBXII-30 side bearing and/or associated with the SBXII-30 elastomer element 114A. In other embodiments, each of the different lock out inserts may have or be of different colors that identify which of the inserts (e.g., similarly colored inserts) are associated with which of the elastomer elements to form the differently rated side bearings.

While the example of FIGS. 9A, 9B, 9C, and 9D shows four combinations, it should be appreciated that other sets may include fewer or additional combinations. Further, the example keys 620A, 620B, 620C, and 620D may be of alternative shape and/or may have additional key features such as tabs, fins, indentations, and grooves, (all not shown) that are associated with corresponding keyed features within the respective interior channels 210A, 210B, 210C, and 210D. It should also be appreciated that the present disclosure contemplates that the key of the lock out insert can be solid or hollowed out.

Figure 10:
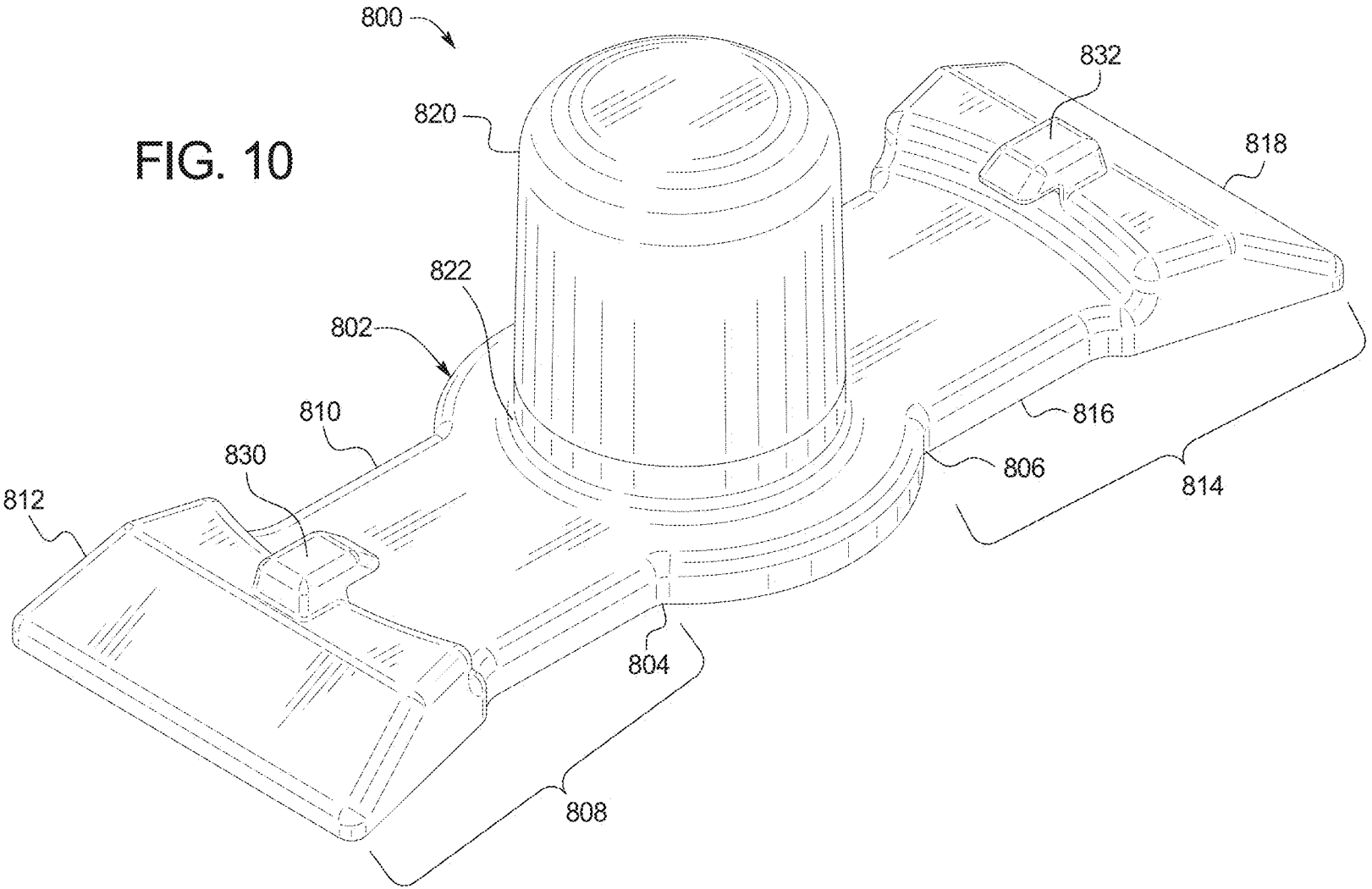
FIG. 10 is a top perspective view of an alternative embodiment of the lock out insert of the present disclosure.
Figure 11:
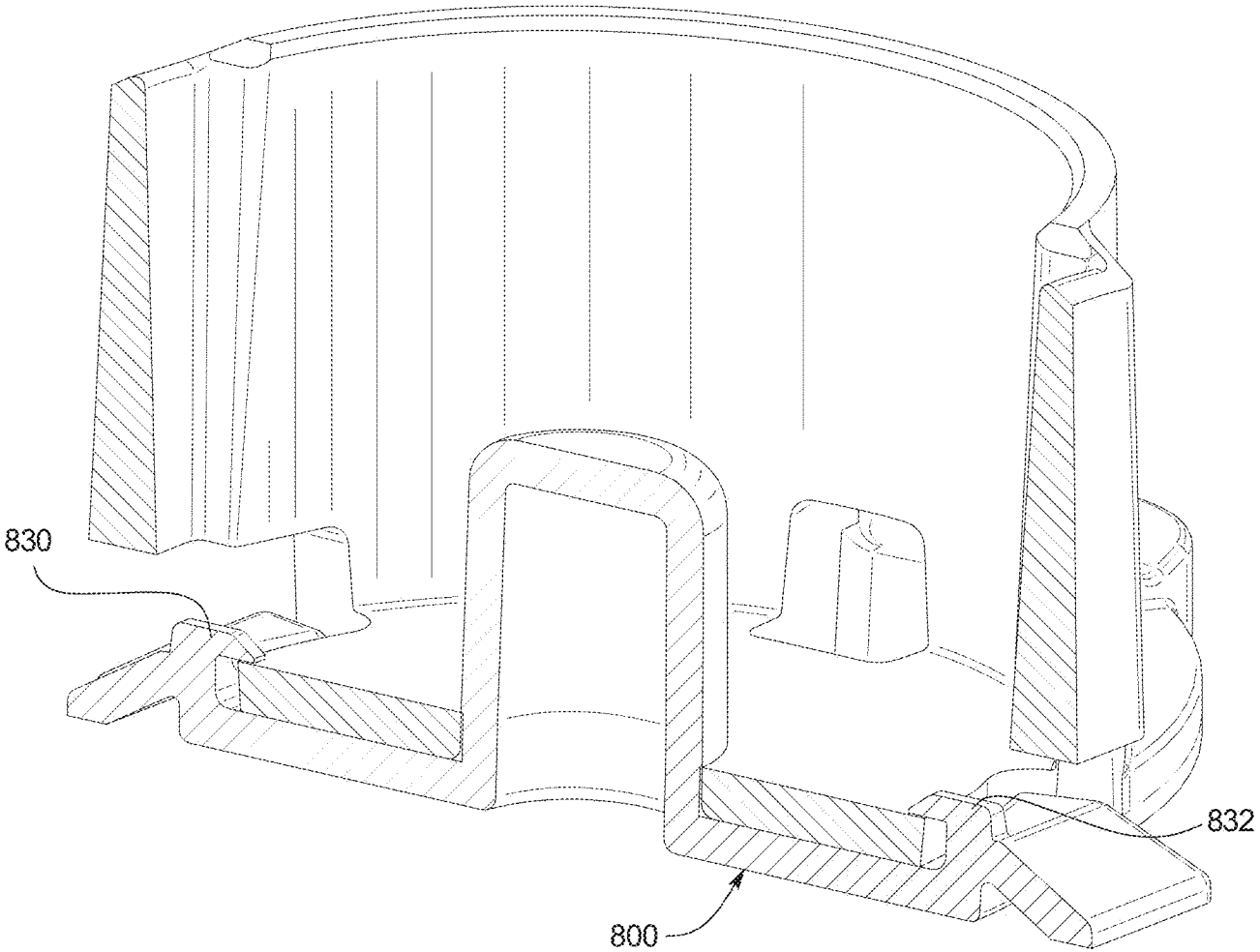
FIG. 11 is a partial cross-sectional view of the lock out insert of FIG. 10 engaging the base of the cage of FIG. 5.

Turning now to FIGS. 10 and 11, an alternative embodiment of the lock out insert of the present disclosure is generally illustrated. This alternative lock out insert 800 (similar to lock out insert 600 described above) includes: (a) a body 802 having a first end 804 and a second end 806; (b) a first arm 808 attached to the first end 804 and including an extension section 810 and a locking tab 812; (c) a second arm 814 attached to the second end 806 of the body 802 and including an extension section 816 and a locking tab 818; (d) a key lip 822 extending from the body 802; and (e) a key 820 extending from the key lip 822. In this embodiment, the lock out insert 800 includes base attachers 830 and 832 respectively extending upwardly from the locking tabs 812 and 818. These base attachers 830 and 832 are configured to engage the top surface 510 of the base 506 of the cage 500 as generally shown in FIG. 11 to hold the lock out insert 800 onto the cage. It should be appreciated that in this embodiment, the lock out insert 800 and in particular the arms 808 and 814 are suitably flexible to enable the arms to bend when the lock out insert 800 is attached to the cage and thus snapped into place such that the base attachers hold the lock out insert to the cage. It should also be appreciated that the base attachers can be somewhat flexible for flexing during attachment to the base. It should also be appreciated that these base attachers do not interfere with the positioning of the elastomer element. It should further be appreciated that in accordance with the present disclosures: (a) the shape of the base attachers may vary; (b) the position of the base attachers may vary; and (c) the quantity of baser attachers may vary.

Figure 12:
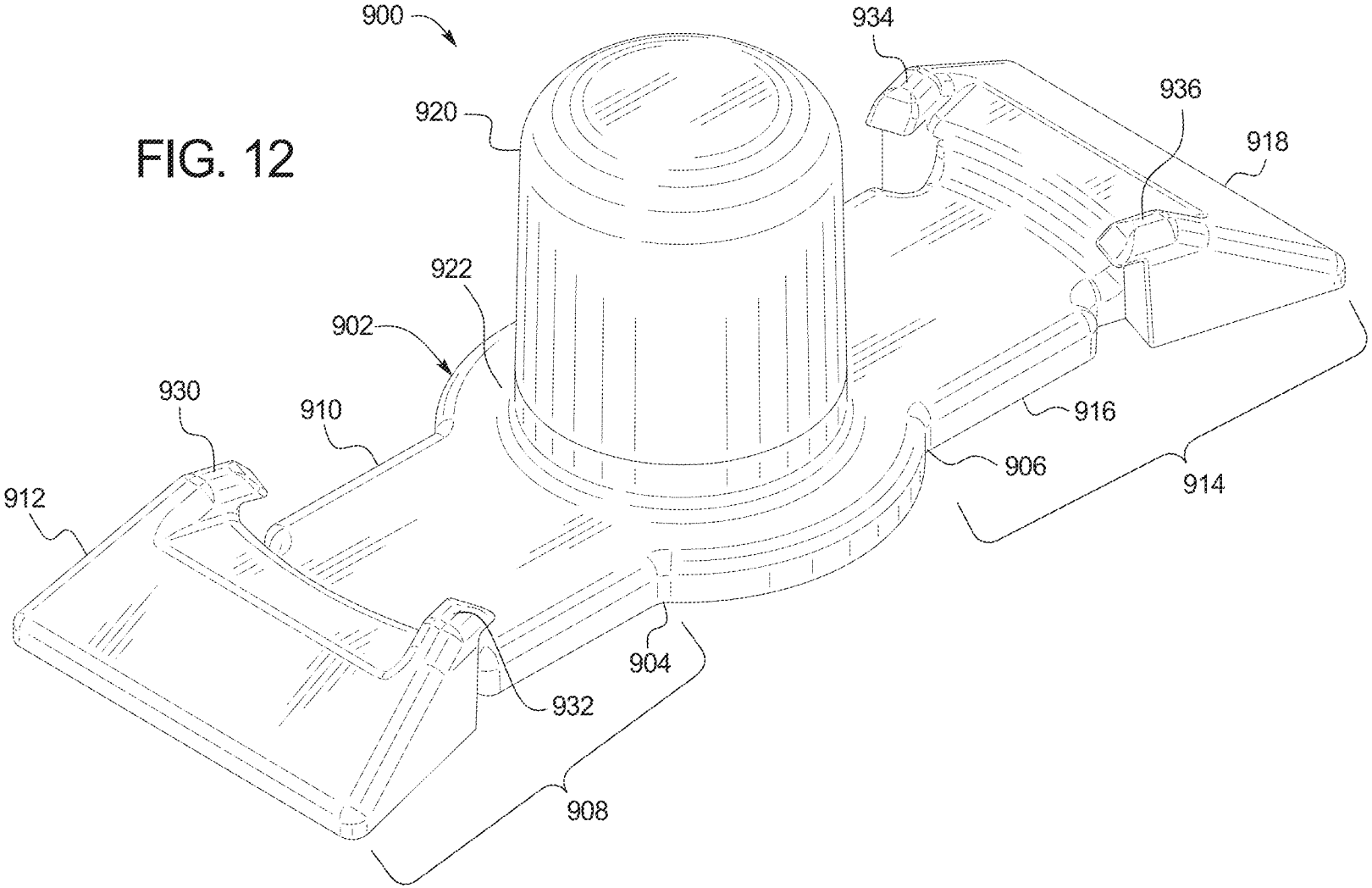
FIG. 12 is a top perspective view of a further alternative embodiment of the lock out insert of the present disclosure.

For example, turning now to FIG. 12, a further alternative embodiment of the lock out insert of the present disclosure is generally illustrated. This alternative lock out insert 900 (similar to lock out insert 600 described above) includes: (a) a body 902 having a first end 904 and a second end 906; (b) a first arm 908 attached to the first end 904 and including an extension section 910 and a locking tab 912; (c) a second arm 914 attached to the second end 906 of the body 902 and including an extension section 916 and a locking tab 918; (d) a key lip 922 extending from the body 902; and (e) a key 920 extending from the key lip 922. In this embodiment, the lock out insert 900 includes base attachers 930, 932, 934, and 936 respectively extending from the corners of locking tabs 912 and 918. These base attachers 930, 932, 934, and 936 are configured to engage the top surface 510 of the base 506 of the cage 500 to hold the lock out insert 900 onto the cage.

It will be understood that modifications and variations may be effected without departing from the scope of the novel concepts of the present invention, and it is understood that this application is to be limited only by the scope of the claims.

The invention is claimed as follows:

1. A railroad car side bearing comprising:

an elastomer element;

a cage having a base and a side wall connected to the base, the cage defining a first locking tab receiving slot, the base defining a key opening, a bottom side of the base defining a lock out insert receiving channel, a top side of the base configured to support the elastomer element;

a lock out insert including:

(a) a body having a first side and a second side;

(b) a first arm having a first side and a second side, the first side of the first arm including a first extension section connected to the first side of the body and the second side of the first arm including a first locking tab, the first extension section configured to be positioned within a first portion of the lock out insert receiving channel, and the first locking tab configured to be positioned within the first locking tab receiving slot; and (c) a key extending from the body and sized to fit through the key opening;

said elastomer element defining an interior channel, a diameter of the interior channel corresponding to a diameter of the key such that the interior channel is configured to receive the key, the elastomer element configured to rest on and be supported by said top side of the base; and a cap connectable to the cage.

2. The railroad car side bearing of claim 1, wherein the cage defines a second locking tab receiving slot, and the lock out insert includes a second arm having a first side and a second side, the first side of the second arm includes a second extension section connected to the second side of the body and the second side of the second arm includes a second locking tab, the second extension section is configured to be positioned within a second portion of the lock out insert receiving channel, and the second locking tab is configured to be positioned within the second locking tab receiving slot.

3. The railroad car side bearing of claim 2, wherein the key opening is positioned between the first locking tab receiving slot and the second locking tab receiving slot.

4. The railroad car side bearing of claim 2, which includes a first base attacher connected to the first locking tab and a second base attacher connected to the second locking tab.

5. The railroad car side bearing of claim 1, wherein the cap includes a top wall and a side wall connected to the top wall.

6. The railroad car side bearing of claim 1, wherein the first extension section of the first arm and the body of the lock out insert are configured to be substantially flush with the bottom side of the base when positioned within the lock out insert receiving channel.

7. The railroad car side bearing of claim 1, wherein the diameter of the interior channel defined by the elastomer element corresponds to the diameter of the key so that a wall of the interior channel is configured to engage a wall of the key to couple the elastomer element to the cage when the key is coupled to the key opening.

8. The railroad car side bearing of claim 1, which includes a first base attacher connected to the first locking tab.

9. A railroad car side bearing set comprising:

a first elastomer element and a second elastomer element;

a cage having a base and a side wall connected to the base, the cage defining a first locking tab receiving slot, the base defining a key opening having a diameter, and a bottom side of the base defining a lock out insert receiving channel, a top side of the base configured to support either the first elastomer element or the second elastomer element;

a first lock out insert and a second lock out insert, each of the lock out inserts including:

a body having a first side and a second side;

a first arm having a first side and a second side, the first side of the first arm including an extension section connected to the first side of the body and the second side of the first arm including a first locking tab, the extension section configured to be positioned within a portion of the lock out insert receiving channel, the first locking tab configured to be positioned within the first locking tab receiving slot; and a key extending from the body and having a diameter sized to fit through the key opening, wherein the diameters of the key of the first lock out insert and key of the second lock out insert are different;

each elastomer element defining an interior channel, a diameter of the interior channel of the first elastomer element corresponding to the diameter of the key of the first lock out insert, and a diameter of the interior channel corresponding of the second elastomer element corresponding to the diameter of the key of the second lock out insert, each elastomer element configured to rest on and be supported by said top side of the base; and a first cap connectable to the cage.

10. The railroad car side bearing set of claim 9, wherein the diameter of the interior channel of the first elastomer element corresponds to the diameter of the key of the first lock out insert so that a wall of the interior channel of the first elastomer element is configured to engage a wall of the first key to couple the first elastomer element to the cage, and the diameter of the interior channel of the second elastomer element corresponds to the diameter of the key of the second lock out insert so that a wall of the interior channel of the second elastomer element is configured to engage a wall of the key of the second lock out insert to couple the second elastomer element to the cage.

11. The railroad car side bearing set of claim 9, wherein the key of the first lock out insert is configured to prevent the second elastomer element from being coupled to the cage.

12. The railroad car side bearing set of claim 9, wherein the first lock out insert has a first color and the second lock out insert has a second color different from the first color.

13. The railroad car side bearing set of claim 12, wherein the first elastomer element has the first color and the second elastomer element has the second color.

14. The railroad car side bearing set of claim 9, wherein the first lock out insert includes a first identifier and the second lock out insert includes a second identifier different from the first identifier.

15. The railroad car side bearing set of claim 14, wherein the first identifier corresponds to a first side bearing part number and the second identifier corresponds to a second different side bearing part number.

16. The railroad car side bearing set of claim 9, which includes a plurality of first base attachers connected to the first locking tabs.

17. A side bearing lock out insert removably attachable to a cage of a railroad car side bearing, said cage including a base, a side wall connected to the base, a first locking tab receiving slot defined by the cage, a key opening defined by the base, and a lock out insert receiving channel defined by a bottom side of the base, a top side of the base configured to support the elastomer element, said side bearing lock out insert comprising:

a body including a first side and a second side, said body configured to extend under the base without engagement by the elastomer element;

a first arm including a first side and a second side, the first side of the first arm including an extension section connected to the first side of the body, the second side of the first arm including a first locking tab configured to fit within the first locking tab receiving slot, the extension section configured to fit within a portion of the lock out insert receiving channel; and a key extending from the body, the key configured to extend through the key opening defined by the base of the cage, the key configured to be inserted into an interior channel of the elastomer element.

18. The side bearing lock out insert of claim 17, which includes a second arm including a first side and a second side, the first side of the second arm connected to a first side of the body and the second side of the second arm including a second locking tab, the second locking tab configured to fit within a second locking tab receiving slot of the cage.

19. The side bearing lock out insert of claim 18, wherein the second locking tab defines a groove configured to receive an edge of the base of the cage.

20. The side bearing lock out insert of claim 18, which includes a first base attacher connected to the first locking tab and a second base attacher connected to the second locking tab.

21. The side bearing lock out insert of claim 17, wherein the first locking tab defines a groove configured to receive an edge of the base of the cage.

22. The side bearing lock out insert of claim 17, which includes a first base attacher connected to the first locking tab.

23. A railroad car side bearing cage comprising:

a base including a bottom side and a top side, said top side configured to support an elastomer element; and a side wall connected to the base, at least one of said base and said side wall defining a first locking tab receiving slot and configured to receive a first locking tab of a first arm of a lock out insert, said base defining a key opening configured such that a key extending from the lock out insert can extend through the key opening, and said bottom side of the base defining a lock out insert receiving channel configured to receive a first side of the lock out insert.

24. The railroad car side bearing cage of claim 23, wherein at least one of said base and said side wall define a second locking tab receiving slot configured to receive a second locking tab of a second arm of the lock out insert.

* * * * *